US006535178B1

(12) United States Patent
Wang

(10) Patent No.: US 6,535,178 B1
(45) Date of Patent: Mar. 18, 2003

(54) ANTENNA DEVICE HAVING A LEARNING FUNCTION AND CAPABLE OF SEARCHING AND MEMORIZING WIRELESS BANDS

(75) Inventor: Cheng-Si Wang, Changhua Hsien (TW)

(73) Assignee: Cheng-Fa Wang, Yungho (TW)

( * ) Notice: Subject to any disclaimer, the term of this patent is extended or adjusted under 35 U.S.C. 154(b) by 36 days.

(21) Appl. No.: 09/983,125

(22) Filed: Oct. 23, 2001

(51) Int. Cl.[7] ..... H01Q 3/00; H01Q 3/02

(52) U.S. Cl. ..... 343/882; 343/766; 318/565; 342/185

(58) Field of Search ..... 343/725, 726, 343/878, 882, 765, 766; 342/176, 185; 318/565

(56) References Cited

U.S. PATENT DOCUMENTS

| | | | | |
|---|---|---|---|---|
| 2,328,024 A | | 8/1943 | Limb | |
| 3,105,236 A | | 9/1963 | McCloud | |
| 3,281,847 A | | 10/1966 | Herrero | |
| 3,478,361 A | | 11/1969 | Middlemark | |
| 3,886,559 A | * | 5/1975 | Lanson et al. | 343/726 |
| 4,538,175 A | * | 8/1985 | Balbes et al. | 343/786 |
| 4,542,326 A | * | 9/1985 | Hornback | 318/565 |
| 4,829,308 A | * | 5/1989 | Tol et al. | 342/176 |
| 5,065,969 A | * | 11/1991 | McLean | 248/282.1 |
| 6,239,744 B1 | | 5/2001 | Singer et al. | 342/359 |
| 6,313,805 B1 | | 11/2001 | Nishiyama | 343/766 |

* cited by examiner

*Primary Examiner*—Tan Ho
(74) *Attorney, Agent, or Firm*—Jones, Tullar & Cooper, P.C.

(57) ABSTRACT

There is provided an antenna device having a learning function and capable of searching and memorizing wireless frequency bands. A control circuit is used to automatically control the receiving angle and direction of an antenna set. When the strongest frequency band is found by the antenna set, a remote control is used to control the circuit for recording the current angle and direction into a memory unit. Afterwards, a user can directly select a pre-stored band identification number to conveniently adjust the antenna device to have the best receiving angle and direction the corresponding capable of receiving the band, thereby decreasing the time to adjust the antenna.

8 Claims, 6 Drawing Sheets

ANTENNA DEVICE HAVING A LEARNING FUNCTION AND CAPABLE OF SEARCHING AND MEMORIZING WIRELESS BANDS

BACKGROUND OF THE INVENTION

1. Field of the Invention

The present invention relates to an antenna device having a learning function and capable of searching and memorizing wireless frequency bands, and more particularly, to an antenna device capable of automatically searching and adjusting the wireless TV band.

2. Description of Related Art

The television has become an almost indispensable device for information and entertainment throughout the world. Cable TV, that is, direct feed of stations to our homes instead of using an antenna system has become increasingly popular because of the many stations available via the former. However, in some remote districts, cable TV may not be available because of the high cost involved for the small quantity of homes, and thus the wireless TV is still important.

As known, the wireless TV has to be installed with an antenna for receiving the wireless video signal. Conventionally, an outdoor antenna has to be established at a position without being obscured, so as to enable the TV set to receive and display clear images. However, the establishment and adjustment of such an outdoor antenna are difficult. Therefore, a compact antenna, such as a ring-shape or telescopic antenna, has been developed for indoor use. Although this ring-shape or telescopic antenna is easy to use, the user may need to manually adjust the receiving angle and direction of the antenna. If a TV program of a different frequency band is desired, the adjustment of antenna must be repeated. Therefore, the use of ring-shape or telescopic antenna is still not satisfactory. Accordingly, there is a desire to have an improved antenna device to mitigate and/or obviate the aforementioned problems.

SUMMARY OF THE INVENTION

The object of the present invention is to provide an antenna device having a learning function and capable of searching and memorizing wireless frequency bands for automatically searching and adjusting the wireless TV band.

To achieve the object, the antenna device of the present invention comprises: a shell; a rotation set arranged in the shell; an antenna set formed on top of the shell and pivotally connected to the rotation set for adjusting its receiving angle by rotating the rotation set; a master controller; a motor connected to the rotation set and connected to an output terminal of the master controller via a driving circuit for being controlled by the master controller to drive the rotation set to rotate; a positioning detector connected between the rotation set and the master controller for detecting a current position of the antenna set, and inputting the detected signal to the master controller; a wireless receiving device connected to an input terminal of the master controller for receiving corresponding signals from a remote control and inputting the received signal to the master controller; a memory connected to the master controller for recording data related to a plurality of bands, wherein the master controller controls the rotation set to adjust the receiving angle of the antenna set by controlling the motor to rotate, and detects the position of the antenna set by the positioning detector for being inputted to the master controller, thereby searching and recording wireless bands.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
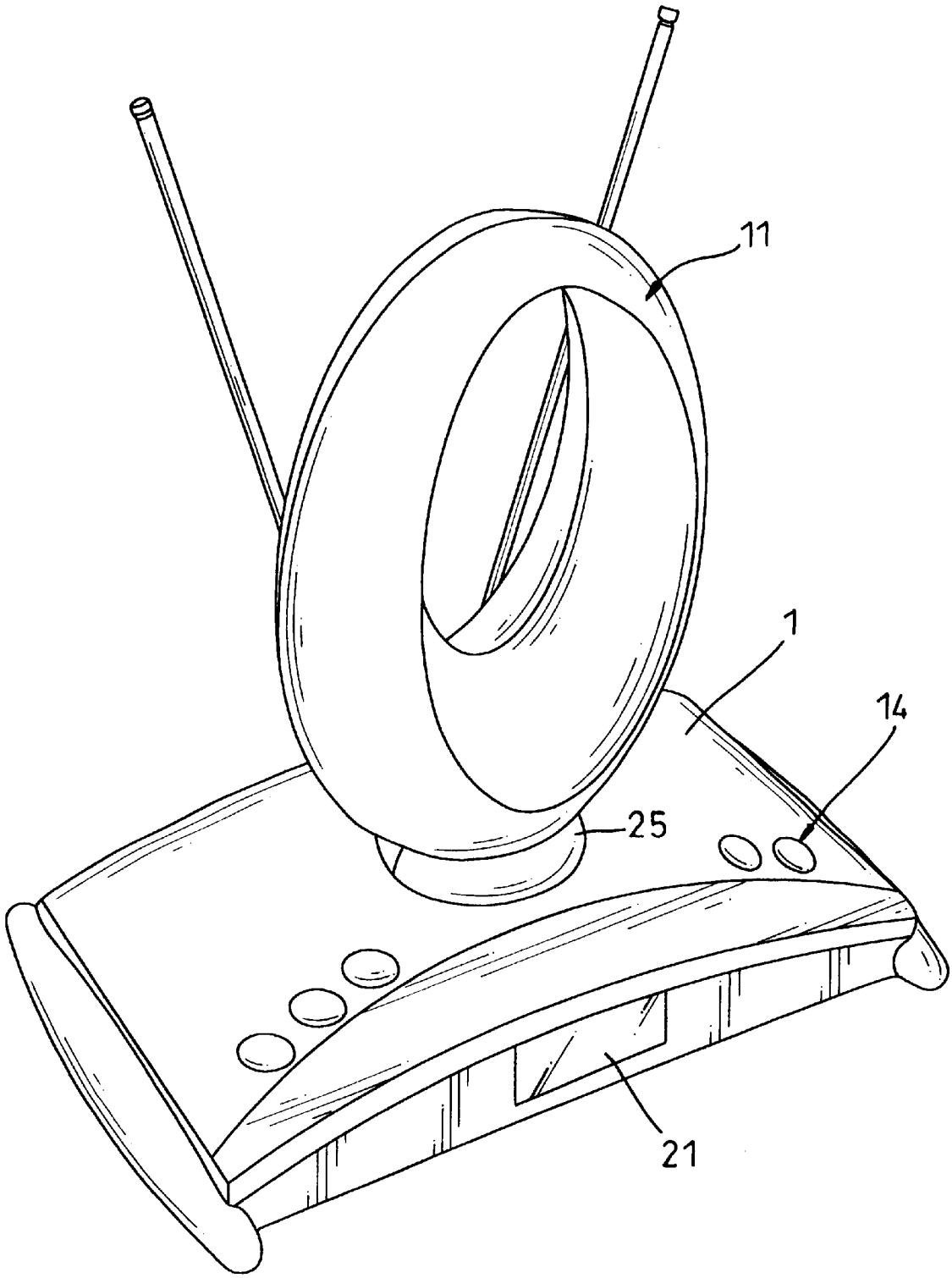
FIG. 1 is a perspective view of the antenna device in accordance with the present invention.
Figure 2:
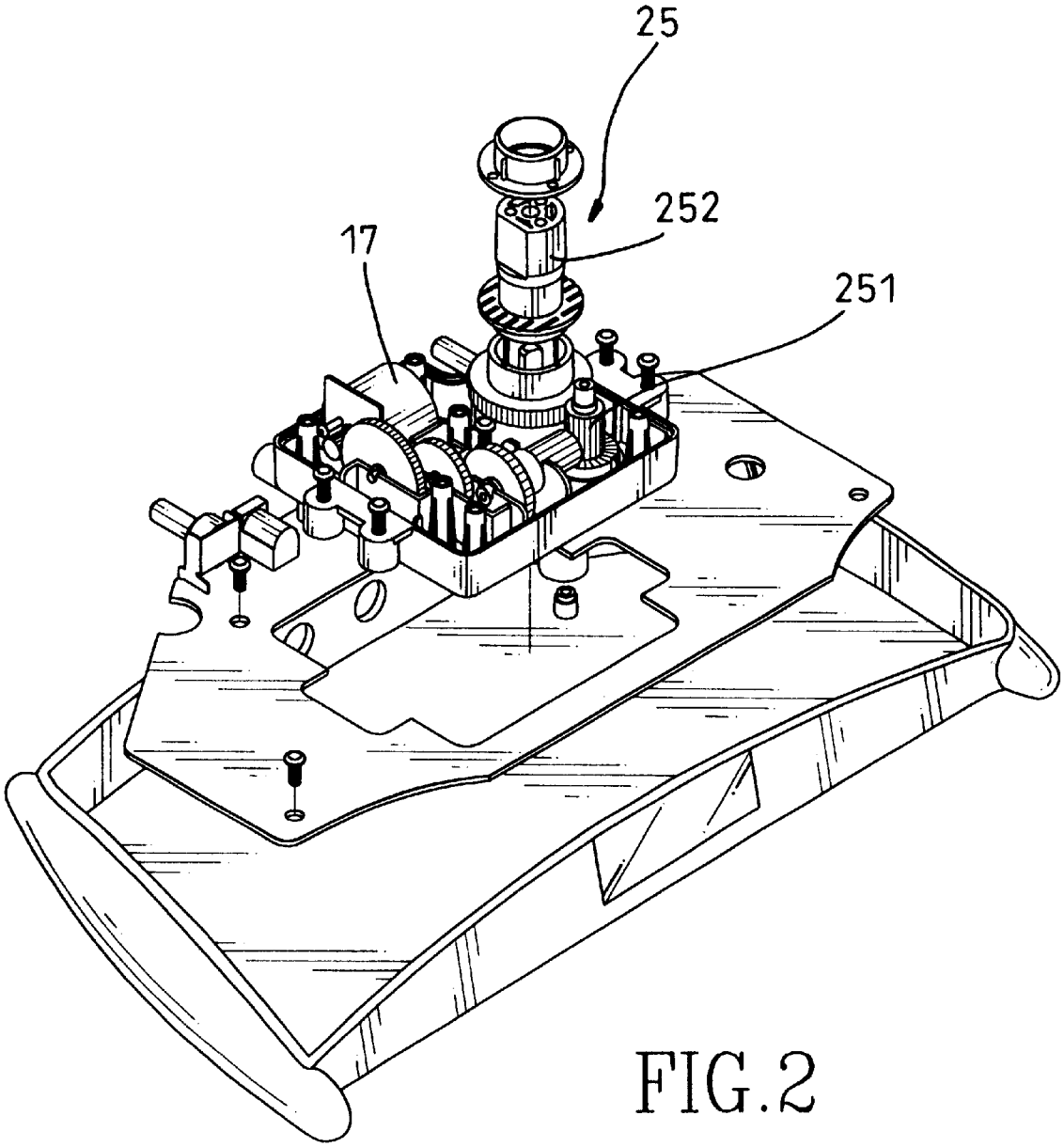
FIG. 2 is a partially exploded view of the antenna device in accordance with the present invention.

FIG. 1 and FIG. 2 illustrate the perspective view and the partially exploded view of the antenna device having a learning function and capable of searching and memorizing wireless frequency bands in accordance with a preferred embodiment of the present invention. As shown, the antenna device includes a shell 1, a rotation set 25 having a pivot 252 and a gear set 251, and an antenna set 11 formed on the top of the shell 1 and connected to the pivot 252 of the rotation set 25 for adjusting its receiving angle and direction by rotating the rotation set 25.

Figure 3:
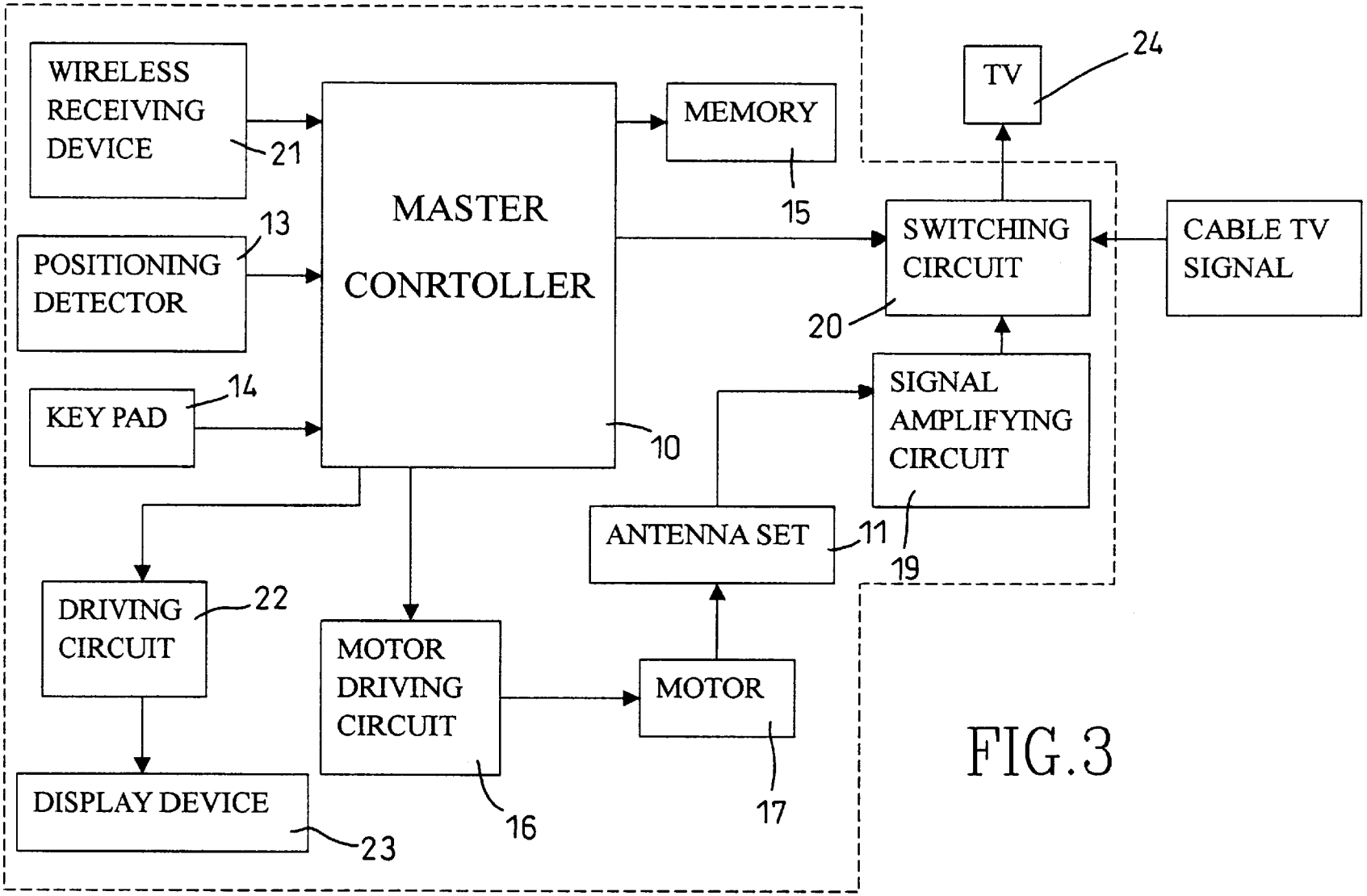
FIG. 3 is a block diagram of the antenna device in accordance with the present invention.

Also with reference to FIG. 3, there is shown a block diagram of the control circuit for adjusting the rotation of the rotation set 25, which includes a master controller 10, a motor 17, a positioning detector 13, a memory 15, a signal amplifying circuit 19, a switching circuit 20, a display device 23, a key pad 14, and a wireless receiving device 21.

The motor 17 is connected to the rotation set 25, and is connected to the output terminal of the master controller 10 via a driving circuit, so as to drive the rotation set 25 to rotate under the control of the master controller 10. The positioning detector 13 is connected to the rotation set 25, and is connected to the master controller 10 for detecting the angle and position of the antenna set 11. The detected signal is sent to master controller 10. In this embodiment, the positioning detector 13 is a potentiometer.

The memory 15 is connected to the master controller 10 for recording the data inputted from the positioning detector 13. The signal amplifying circuit 19 is connected to the output terminal of the antenna set 11 for 20 amplifying the output signal from the antenna set 11.

The switching circuit 20 is connected to the output terminal of the master controller 10, and is connected between the signal amplifying circuit 19 and the cable TV signal terminal for switching either the wireless TV signal or the cable TV signal to a TV 24.

The display device 23 is connected to the master controller 10 via the driving circuit 22 for being driven by the master controller 10 to display. The control key pad 14 is connected to the input terminal of the master controller 10.

Figure 5:
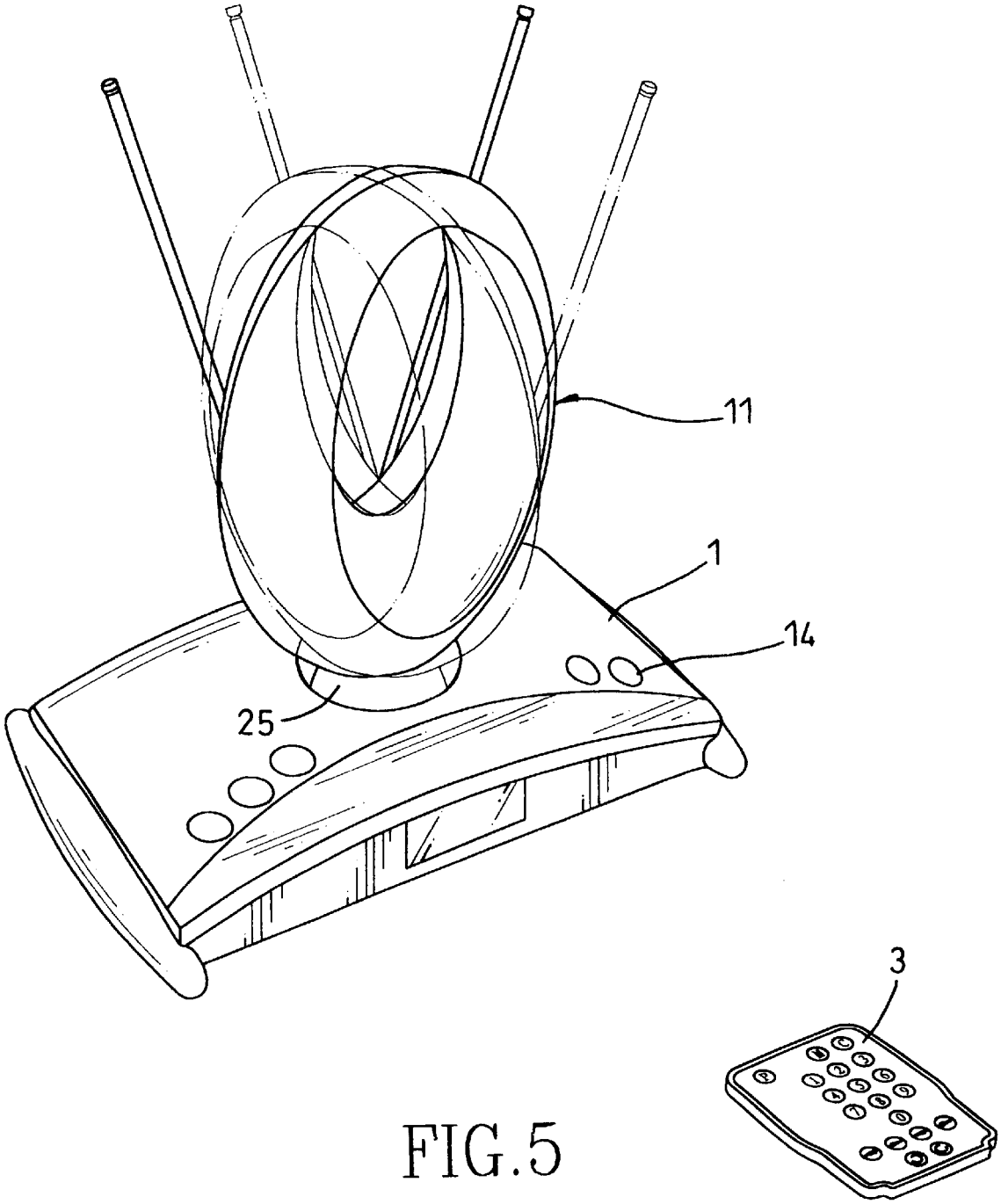
FIG. 5 schematically illustrates the operation of the antenna device in accordance with the present invention.

The wireless receiving device 21 is connected to the input terminal of the master controller 10 for receiving a signal from a remote control 3 as shown in FIG. 5, and the received signal is inputted to the master controller 10. In this embodiment, the wireless receiving device 21 is an infrared receiving module (such a wireless remote control which is not restricted to a specific brand).

The aforementioned antenna device utilizes the master controller 10 to control the motor 17 in the rotation set 25 to rotate, and drive the gear set 251 to rotate. Furthermore, the pivot 252 is engaged with the gear set 251, and thus the gear set 251 can activate the antenna set 11 to rotate, thereby adjusting the angle of the antenna set 11 and the adjustment value of the positioning detector 13.

In use of the antenna device in accordance with the present invention, the antenna set 11 is fixed in a specific angle to receive clear video signals. Because the positioning detector 13 and the antenna set 11 are simultaneously activated by the rotation of the rotation set 25, when the antenna set 11 is adjusted to have a specific angle, the resistance of the positioning detector 13 is changed to obtain a corresponding voltage signal for being inputted to the master controller 10. The master controller 10 thus stores the voltage signal as a switched band number into the memory 15 for being associated with the current channel identification number. Afterwards, when a corresponding channel number is entered by the key pad 14 or the remote control, the master controller 10 directly controls the rotation set 25 to rotate, so as to move the antenna set 11 to have an angle capable of receiving signals represented by the band number.

Figure 4A:
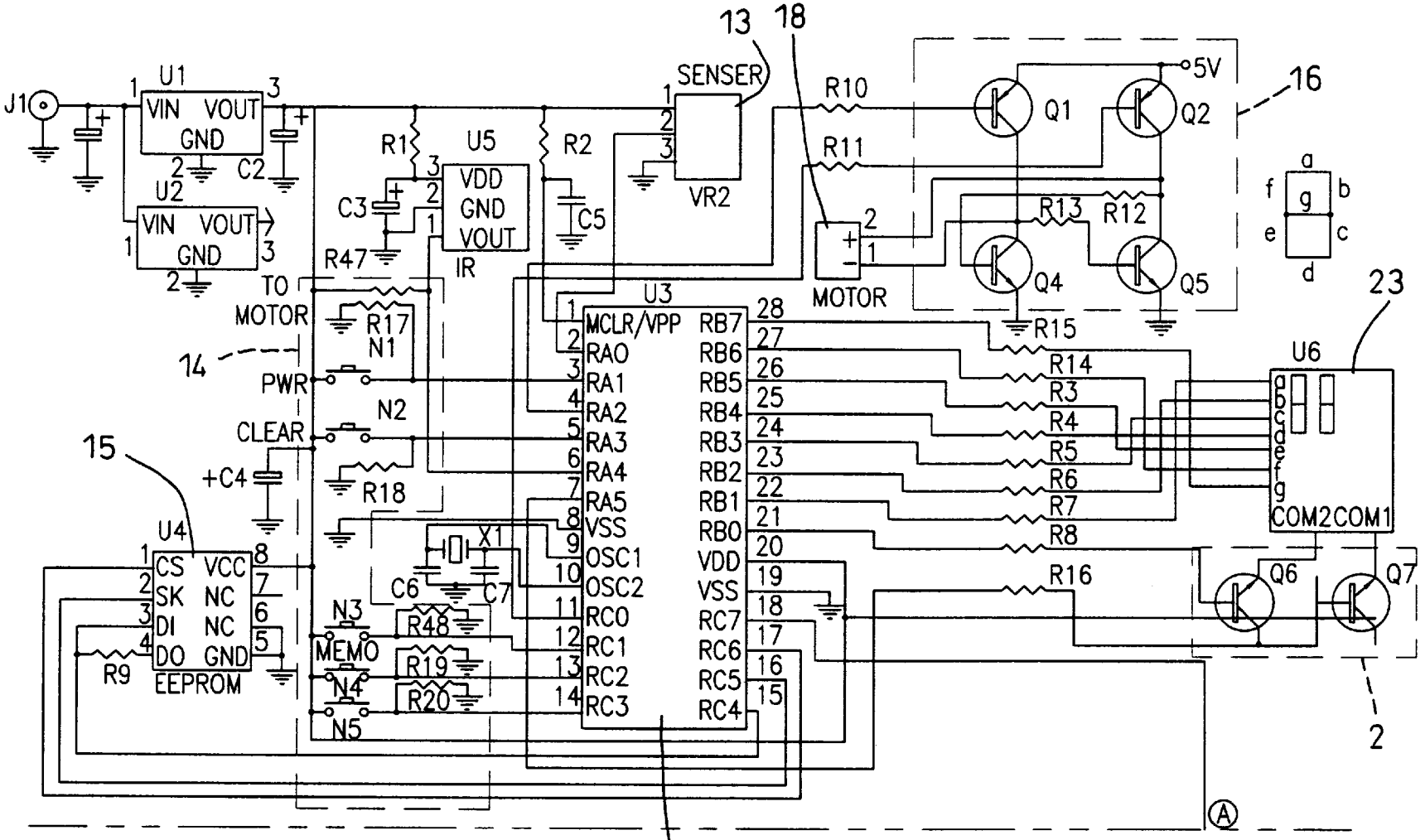
FIGS. 4A and 4B show the circuit diagram of the antenna device in accordance with the present invention.
Figure 4B:
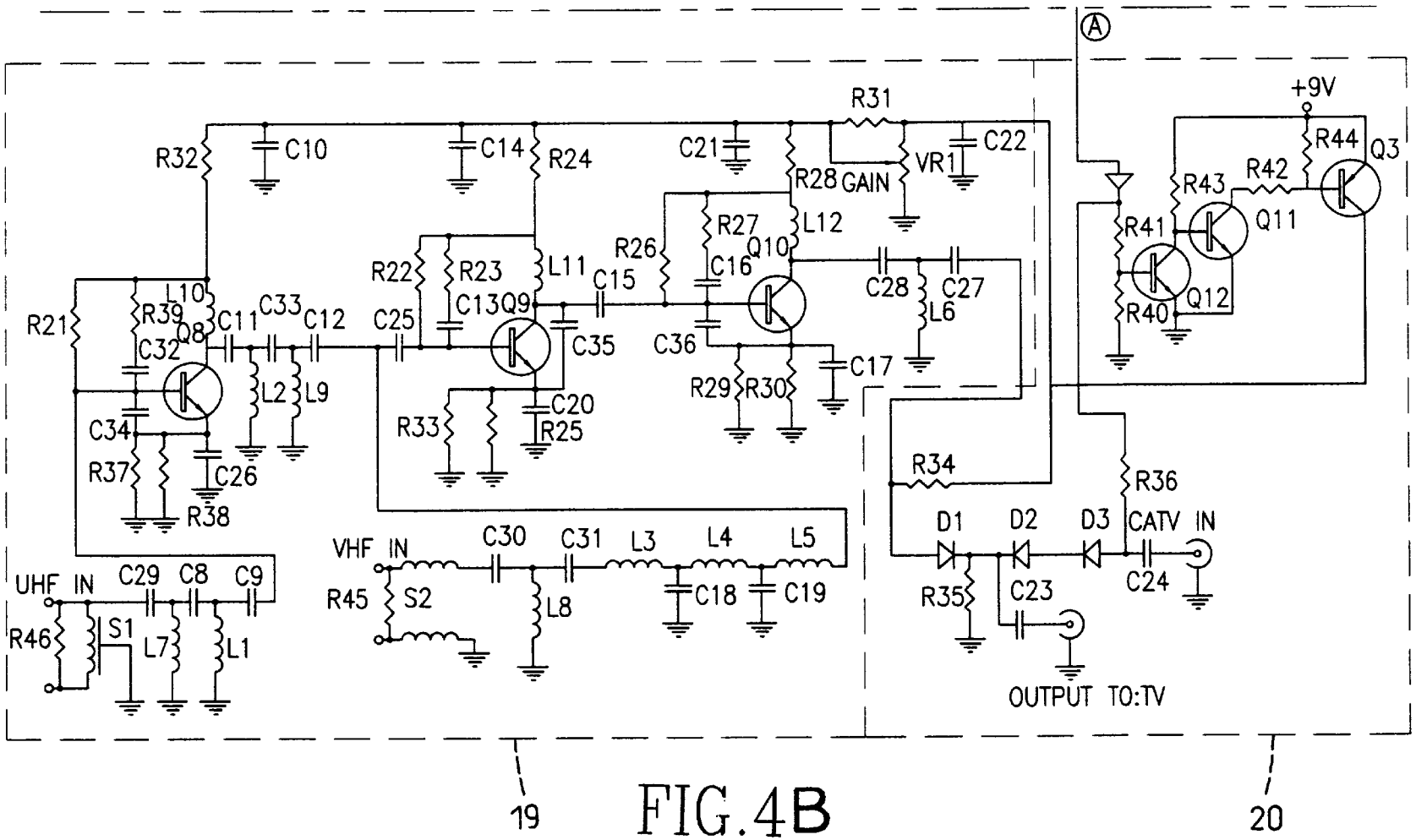

With reference to FIGS. 4A and 4B, there is shown the detailed circuit diagram of the control circuit. As shown, the master controller 10 is a microprocessor (U3), whose input terminals are connected to the positioning detector 13 (VR2), the key pad 14 (N1~N5), and infrared receiving module (U5) for receiving the control signal inputted from the remote control (not shown). The microprocessor (U3) has two output terminals (RA2, RC0) connected to a motor driving circuit 16 formed by two sets of complementary transistors (Q1/Q5, Q2/Q4), wherein the motor 17 is connected to the output terminal of the motor driving circuit 16. If the two output terminals (RA2, RC0) of the microprocessor (U3) output high voltage levels at the same time, both of the two sets of complementary transistors (Q1/Q5, Q2/Q4) are not conducted. If the output terminal (RA2) outputs a high voltage level and the output terminal (RC0) outputs a low voltage level, the transistor set (Q2/Q4) is conducted and the motor 17 is rotated in a positive direction. On the contrary, if the output terminal (RA2) outputs a low voltage level and the output terminal (RC0) outputs a high voltage level, the transistor set (Q1/Q5) is conducted and the motor 17 is rotated in a reverse direction.

In addition, the memory 15 is preferred to be an EEPROM, and the signal amplifying circuit 19 has three stages of amplifiers, each being composed of NPN transistors (Q8, Q9, Q10) and resistors, so as to increase the overall amplifying gain of the signal amplifying circuit 19. The output terminal of the previous stage and its working power are both connected to the switching circuit 20. The switching circuit 20 is connected to the output terminal (RC7) of the microprocessor (U3), and is composed of transistors (Q11, Q12, Q3). When the output terminal RC7 outputs a high voltage level, the PNP transistor (Q3) is not conducted and thus disconnects the working power supplied to the signal amplifying circuit 19. At this moment, the two diodes (D2, D3) connected to the signal terminal of cable TV are still conducted. Therefore, the cable TV signal (CATV IN) is directed to the output terminal (OUTPUT), so as to transmit the cable TV signal to the TV set. On the contrary, when the output terminal RC7 outputs a low voltage level, the PNP transistor (Q3) is conducted and thus the working power can be supplied to the signal amplifying circuit 19 so that the signals received by the antenna set 11 can be transmitted to the output terminal (OUTPUT) via the diode (D1) for being sent to the TV set (not shown).

FIG. 5 is a schematic diagram illustrating the operation of the antenna device in accordance with the present invention. As shown, the antenna set 11 is moved in response to the rotation of the rotation set 25. Therefore, when the master controller 10 controls the motor 17, the receiving angle of the antenna set 11 can be adjusted, thereby achieving the purpose of searching and recording signals from various directions.

In view of the foregoing, as no default band is set in the master controller, the present invention is able to automatically set the optimal receiving band in the first-time use, and program a channel identification number. In addition, with the designs of various remote controls, it is easy for the user to operate the antenna device in accordance with the present invention. Therefore, the present antenna device not only can search and learn, but also can memorize the searched bands.

Although the present invention has been explained in relation to its preferred embodiment, it is to be understood that many other possible modifications and variations can be made without departing from the spirit and scope of the invention as hereinafter claimed.

What is claimed is:

1. An antenna device having a learning function and capable of searching and memorizing wireless bands, comprising:

a shell;

a rotation set arranged in the shell;

an antenna set formed on top of the shell and pivotally connected to the rotation set for adjusting its receiving angle by rotating the rotation set;

a master controller;

a motor connected to the rotation set and connected to an output terminal of the master controller via a driving circuit for being controlled by the master controller to drive the rotation set to rotate;

a positioning detector connected between the rotation set and the master controller for detecting a current position of the antenna set, and inputting the detected signal to the master controller;

a wireless receiving device connected to an input terminal of the master controller for receiving corresponding signals from a remote control and inputting the received signal to the master controller; and a memory connected to the master controller for recording data related to a plurality of frequency bands, wherein the master controller controls the rotation set to adjust the receiving angle of the antenna set by controlling the motor to rotate, and detects the position of the antenna set by the positioning detector for being inputted to the master controller, thereby searching and recording wireless frequency bands.

2. The antenna device having a learning function and capable of searching and memorizing wireless bands as claimed in claim 1, wherein the rotation set comprises a pivot and a gear set for controlling the pivot to rotate, and the gear set is connected to the motor for being driven by the motor.

3. The antenna device having a learning function and capable of searching and memorizing wireless bands as claimed in claim 2, wherein the wireless receiving module is an infrared receiving module.

4. The antenna device having a learning function and capable of searching and memorizing wireless bands as claimed in claim 1, further comprising a key pad connected to an input terminal of the master controller.

5. The antenna device having a learning function and capable of searching and memorizing wireless bands as claimed in claim 1, further comprising a signal amplifying circuit connected to an output terminal of the antenna set for amplifying output signals from the antenna set.

6. The antenna device having a learning function and capable of searching and memorizing wireless bands as claimed in claim 5, further comprising a switching circuit connected to an output terminal of the master controller, and connected between the signal amplifying circuit and a cable TV signal terminal for switching either wireless TV signals or cable TV signals to a TV.

7. The antenna device having a learning function and capable of searching and memorizing wireless bands as claimed in claim 1, further comprising a display device connected to the master controller via a display driving circuit for being driven by the master controller to display.

8. The antenna device having a learning function and capable of searching and memorizing wireless bands as claimed in claim 1, wherein the positioning detector is a potentiometer.

* * * * *